United States Patent [19]

Gagnon et al.

[11] 4,431,081

[45] Feb. 14, 1984

[54] SUSPENSION SYSTEM FOR MOVEMENT UNDER A CEILING

[76] Inventors: Pierre Gagnon, 5637, Wilderton Ave., Montreal, Quebec, Canada, H3T 1S1; Pierre LaForest, 1945, Bruxelles, Montreal, Quebec, Canada, H1L 5Z5

[21] Appl. No.: 441,486

[22] Filed: Jan. 21, 1983

[51] Int. Cl.[3] ..... A63B 25/00

[52] U.S. Cl. ..... 182/36; 182/134; 182/150; 272/70.1

[58] Field of Search ..... 182/36, 134, 150, 221; 272/70.1, 70.2

[56] References Cited

U.S. PATENT DOCUMENTS

| | | | |
|---|---|---|---|
| 128,882 | 7/1872 | Hunt | 182/36 |
| 521,811 | 6/1894 | Piepenbring | 272/70.1 |
| 810,254 | 1/1906 | Borneman | 182/134 |
| 917,805 | 4/1909 | Shaw | 182/134 |
| 1,814,688 | 7/1931 | Goodrich | 182/150 |
| 2,646,282 | 7/1953 | Ringman | 272/70 |
| 3,851,729 | 12/1974 | Gordon | 182/36 |

FOREIGN PATENT DOCUMENTS

| | | | |
|---|---|---|---|
| 37840 | 4/1965 | German Democratic Rep. | 182/36 |

*Primary Examiner*—R. P. Machado

[57] ABSTRACT

A suspension system for a person under a ceiling is disclosed, consisting of a false ceiling composed of a plurality of spaced-apart tiles each of a regular geometric shape. Slots are thus defined between the tiles. The latter is also downwardly spaced from the regular roof or ceiling and is rigidly secured thereto, thereby defining a space between the tiles and the roof. At least one pair of stilts is used in combination with the ceiling. Each stilt is adapted to move in the slots and is provided with a suspension flange at its upper end and a foot support at its lower end, thereby enabling a user to "walk" under the ceiling.

6 Claims, 5 Drawing Figures

SUSPENSION SYSTEM FOR MOVEMENT UNDER A CEILING

FIELD OF THE INVENTION

The present invention relates to suspension means for supporting a person above ground, more specifically to a suspension system for one or more workers immediately under an edifice ceiling for service work thereat.

BACKGROUND OF THE INVENTION

In many if not most buildings designed specifically for the presentation of entertainment, such as theaters, sports stadiums and concert halls, lighting fixtures, show curtains and the like are normally suspended from the roof of the building or an adjacent ceiling thereof. It is frequently necessary to do work on these fixtures; for example to change the angle of projection of spotlights or to effect repairs on the same or other such fixtures.

Till now the means to attend to the fixtures have consisted of walkways or screened suspended floors. The principal disadvantages of such constructions are that they are expensive to build and that the fixtures are not infrequently located in somewhat awkward positions due to their presence.

OBJECTS OF THE INVENTION

Accordingly an important object of the present invention is to provide a suspension system adjacent the roof or ceiling of a building which is entirely safe and allows multi-directioned movement under such a roof or ceiling.

It is another object of the present invention to provide a suspension system of the above type which accomplishes the above-mentioned movement by means of a plurality of sapced-apart tiles rigidly secured to the roof or ceiling, in combination with a pair of inverted stilts, the latter being movably supported in the slots defined by the tiles and designed to support a single person.

It is yet another object of this invention to provide a suspension system of the above type which is also adapted to support fixtures such as lights and other fixtures of a technical nature.

SUMMARY OF THE INVENTION

The above and other objects and advantages of the present invention are realized according to a preferred embodiment comprising, firstly, a false ceiling consisting of a plurality of identical tiles, each of a regular geometric shape. Attachment means are provided to fix each tile to the regular ceiling or roof of a building in downwardly-spced relationship to the roof or ceiling. The tiles are also arranged in consistent horizontally-spaced relationship, thereby defining a plurality of horizontally extending slots between the tiles.

Secondly, and in combination wih this false ceiling, there is provided at least one pair of inverted stilts each having an upper end and a lower end. The upper end extends through a slot and is formed with a flange overlying the tiles whereby the stilt is suspended from the tiles and can move freely in the slot. The lower end is in turn provided with a foot support means. Preferably the latter is adjustable to accommodate users of different heights.

The flanges at the upper end of each stilt is such that the stilt can be lifted upwardly, a certain distance between the tiles and the adjacent roof or ceiling.

The suspension system is used as follows: a pair of stilts is inserted one in each of two parallel slots at one side of the false ceiling where the ends of the slots are located. Then the user positions him or herself on the stilts with one foot in each foot support means and with each hand grasping a stilt at the upper portions of the latter. To move under the false ceiling, the user simply lifts one stilt at a time with his or her hand and moves that stilt, along with the corresponding leg, then releases the stilt so that it is once again supported by the flange in its new position. Thus a user can move to any position under the false ceiling along two parallel and spaced-apart slots to attend to the various fixtures located thereunder It is to be noted that the fixtures themselves can also be supported under the false ceiling by the suspension means.

BRIEF DESCRIPTION OF THE DRAWINGS

The above will be more clearly understood by having referal to the preferred embodiment of the invention, illustrated by way of the accompanying drawings, in which.

Like numerals refer to like elements throughout the drawings.

DETAILED DESCRIPTION OF THE PREFERRED EMBODIMENT

Figure 1:
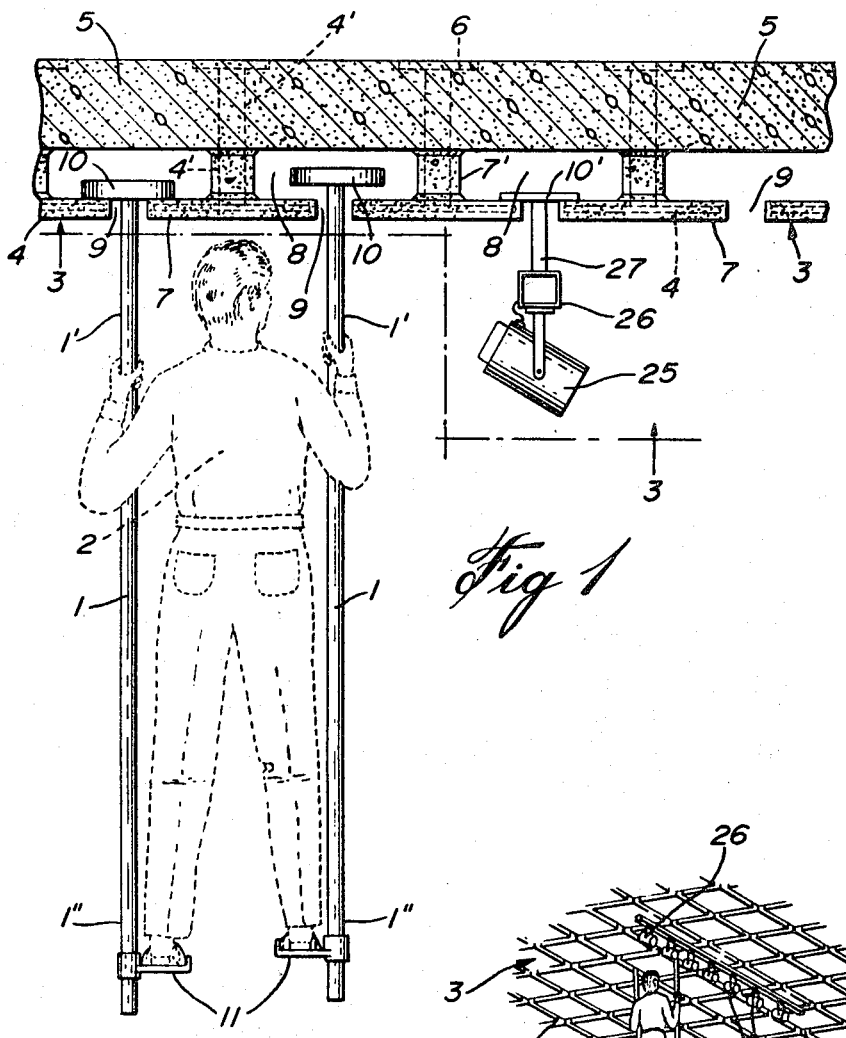
FIG. 1 is an elevational view of a pair of stilts seconding to the invention, also showing the regular ceiling and tiles in cross-section, and a user in dashed outline.

Referring firstly to FIG. 1 there is shown a pair of upright stilts 1 supporting a person 2. Stilts 1 are made of suitable rigid material and have an upper portion 1' and a lower portion 1''.

Each pair of stilts 1 is adapted to be used in combination with a false ceiling indicated generally by the numeral 3. The false ceiling consists entirely of tiles 4. These tiles 4 have a flat top face and are provided with an attachment means formed of an anchoring stem 4' which is centrally located at and projects upwardly from the upper surface of each tile. As shown clearly in FIG. 1, each stem 4' is rigidly secured to a roof or ceiling 5, by extending therethrough and being bitted with an anchoring plate 6 at its upper end. Roof 5 depisted in FIG. 1 is made of concrete although it will be clear that other material can be used. Preferably tiles 4 are made of metal and covered with a plastic or ruffer surface 7 to reduce noise and provide better acoustics.

From the above description, it will be clear that a space B is defined between the tiles 4 and roof 5. A spacer sleeve 7' may surround the free lower portion of each stem 4' to ensure uniform spacing of tiles 4 downwardly from ceiling 5 so that the top flat faces of tiles 4 are co-planar and horizontal.

The tiles 4 are of regular geometric shape, preferably square, as shown in the drawings. However, other shapes such as triangular or rectangular shapes could be effectively used.

Figure 2:
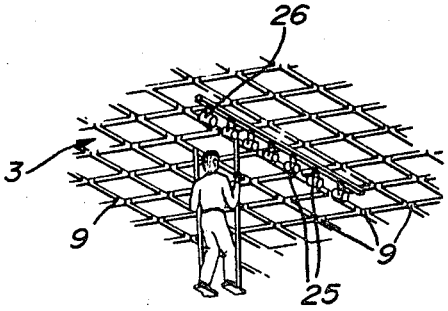
FIG. 2 is a perspective view of the false ceiling and stilts, a user on the stilts, and a row of fixtures also suspended from the false ceiling.
Figure 3:
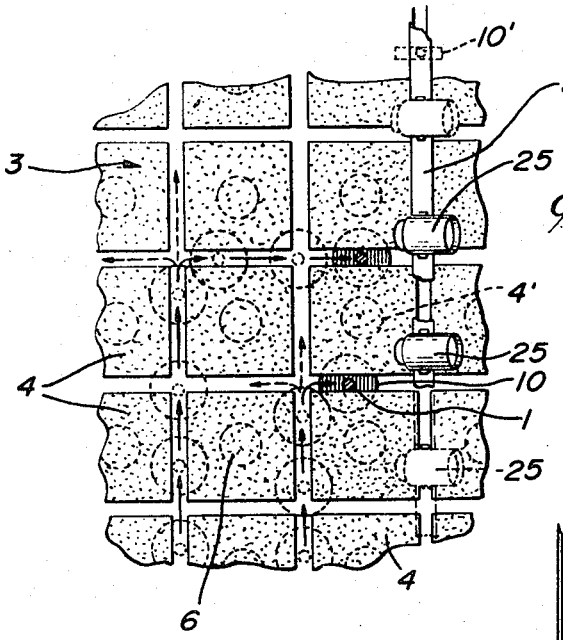
FIG. 3 is a cross-sectional view taken along lines 3—3 of FIG. 1.
Figure 4:
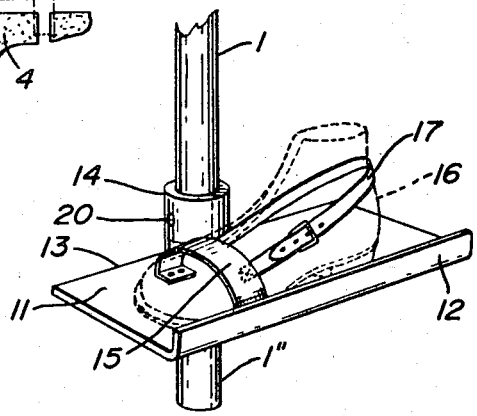
FIG. 4 is a perspective view of the foot support means also showing a boot in dashed outline.

As shown in FIGS. 1, 2 and 3 tiles 4 are horizontally spaced-apart from each other thereby defining a plurality of spaced-apart horizontal slots 9, which are preferably arranged in pairs of parallel straight slots, intersecting one another to form a grid of slots.

Each stilt 1 is provided at its upper end with a suspension means consisting of a rigid round flange 10 which is horizntally disposed in space 8 and overlies tiles 4. Thus stilts 1 extend freely through slots 9 and are suspended from tiles 4 by flanges 10. The underface of flange 10 is preferably flat and perpendicular to stilt 1, such that the latter is maintained vertical.

Figure 5:
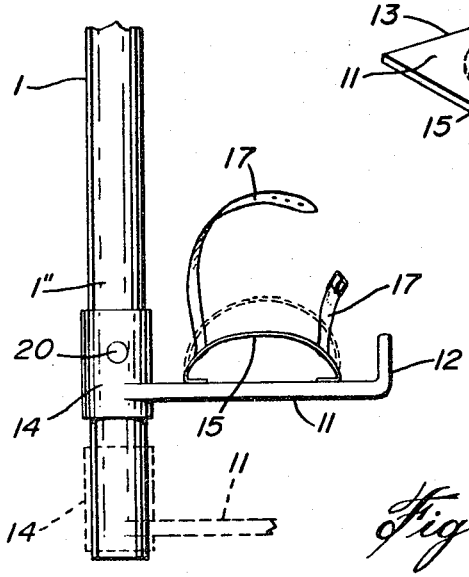
FIG. 5 is an elevation view of the foot support and the lower portion of a stilt.

The lower end portion 1'' of each stilt is further provided with a foot support means comprising a flat foot plante 11, having an upstanding flange 12, along its outer side edge. The inner side edge 13 of plate 11 is integrally formed with a vertically-oriented sleeve 14, which is adapted to receive the lower end portion of a stilt 1. Lock means to prevent vertical movement of plate 11 relative to stilt 1 are also provided, consisting of a set screw or other like and safe lock means indicated at 20. The latter can also serve as a height adjustment means for foot plante 11, as suggested by the dashed outline in FIG. 5.

The top surface of foot plante 11 carries a boot harness means consisting of a first strap 15 extending over the toe portion of the boot or shoe 16 of a user, and a second strap 17 secured at either side of the first strap 15 and extending around the heel portion of the shoe or boot 16. Preferably the second strap 17 is adjustable to fit footwear of varying size.

As explained above stilts 1 are used by firstly inserting two stilts, one in each of two parallel and spaced-apart slots, at one end of the false ceiling 3 (not shown). Then, a user positions each foot in one of the front support plates 11 and grasps each stilt 1 at the upper portion thereof with one hand, as shown in FIG. 1. It will be clear from the latter figure that stilts 1 can be lifted, one at a time, into space 8 and thus pushed forwardly or rearwardly in the slots 9. As suggested by FIG. 3, turns can be accomplished in the same way.

It is to be noted that the suspension means of stilts 1 can be provided for the fixtures. By way of example, such fixtures are represented in FIGS. 1, 2 and 3 by spotlights 25. The latter is preferably secured to a bar 26 which extends underneath one of the slots 9 of the false ceiling 3. Each end of bar 26 is supported in the corresponding slot 9 by a vertical rod 27 and a flange 10', as for stilts 1. Obviously each spotlight 25 can be supported by itself with a rod 27 and a flange 10'.

It is to be noted as well that a safety belt or harness (not shown) can be provided around the waist or chest of person 2, whereby he or she can be safely attached to stilts 1, while the hands remain free.

Moreover, each pair of stilts can be placed in the same slot, whereby person 2 can move laterally crabwise.

What we claim are:

1. A suspension system for movement under a ceiling comprising, in combination, a false ceiling formed of a plurality of tiles, each of a regular geometric shape; attached means to rigidly secure each said tile to the regular roof or ceiling of a building with said tiles being in downwardly-spaced relationship, relative to said regular roof; said tiles being also arranged in consistent horizontally spaced relationship, defining a plurality of horizontally extending slots between said tiles; further comprising at least one pair of inverted stilts, each having an upper end and a lower end; said upper and freely extending through a slot, a flange overlying adjacent tiles under said roof or ceiling and secured to said upper end to support each stilt in one of said slots; said lower end being provided with a foot support means.

2. A suspension system as defined in claim 1 wherein said flange has a flat underside perpendicular to said stilt and the top surfaces of said tiles are flat and co-planar whereby said flange can rest flat on two adjacent tiles with said stilt maintained vertical.

3. A suspension system as defined in claim 1 or 2, wherein said attachment means consist of an anchoring stem rigidly secured to and projecting upwardly from the central portion of the upper surface of said tile, and having an upper end portion rigidly occured to the said roof or ceiling.

4. A suspension system as defined in claim 1 or 2, wherein said foot support means includes a flat horizontal plate having an outer side edge provided with an upstanding flange and an inner side edge, the latter having integrally formed therewith a vertically oriented sleeve adapted to receive the lower end portion of a said stilt; said sleeve having lock means to prevent its slippage on said stilt.

5. A suspension system as defined in claim 1 or 2, wherein said tiles form a grid of intersecting straight slots, parallel two by two.

6. A suspension system as defined in claim 1 or 2, wherein each said tile is of square configuration.

* * * * *